US011604001B2

(12) United States Patent
Brise et al.

(10) Patent No.: US 11,604,001 B2
(45) Date of Patent: Mar. 14, 2023

(54) SLIM FAN COIL UNIT

(71) Applicants: Carrier Corporation, Palm Beach Gardens, FL (US); Stephane Brise, Maubec (FR)

(72) Inventors: Stephane Brise, Maubec (FR); Franck Veuillet, Nievroz (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 242 days.

(21) Appl. No.: 16/976,625

(22) PCT Filed: Mar. 6, 2018

(86) PCT No.: PCT/IB2018/000322
§ 371 (c)(1),
(2) Date: Aug. 28, 2020

(87) PCT Pub. No.: WO2019/171096
PCT Pub. Date: Sep. 12, 2019

(65) Prior Publication Data
US 2021/0003300 A1 Jan. 7, 2021

(51) Int. Cl.
*F24F 7/007* (2006.01)
*F24F 1/0018* (2019.01)
(Continued)

(52) U.S. Cl.
CPC ..... *F24F 7/007* (2013.01); *F24F 1/0018* (2013.01); *F24F 11/81* (2018.01); *F24F 13/20* (2013.01)

(58) Field of Classification Search
CPC ..... F24F 11/81; F24F 1/0018
See application file for complete search history.

(56) References Cited

U.S. PATENT DOCUMENTS

| | | | | |
|---|---|---|---|---|
| 7,108,478 | B2 | 9/2006 | Hancock | |
| 7,266,971 | B2 | 9/2007 | Kang | |
| 10,386,079 | B2 * | 8/2019 | Kim | F24F 1/0033 |

FOREIGN PATENT DOCUMENTS

| | | | |
|---|---|---|---|
| CN | 202709307 | U * | 1/2013 |
| EP | 2977689 | A1 | 1/2016 |
| WO | 2006078083 | A2 | 7/2006 |

OTHER PUBLICATIONS

International Search Report for Internation Application No. PCT/IB2018000322; International Filing Date Mar. 6, 2018 dated Nov. 13, 2018, 5 pages.

(Continued)

*Primary Examiner* — Steven S Anderson, II
(74) *Attorney, Agent, or Firm* — Cantor Colburn LLP

(57) ABSTRACT

A fan coil unit includes a cabinet, a heat exchanger located in the cabinet, an airflow inlet to admit an airflow into the cabinet, and an airflow outlet to allow the airflow to exit the cabinet. A fan is located in the cabinet to urge the airflow through the cabinet. The fan has an axis of rotation perpendicular to a general flow direction of the airflow. A method of operating a fan coil unit includes flowing an airflow into a cabinet via an airflow inlet and through a fan. The fan is oriented such that a fan axis of rotation is perpendicular to a general flow direction of the airflow from the airflow inlet to an airflow outlet. The airflow is urged across a heat exchanger located in the cabinet, the heat exchanger conditioning the airflow and is output from the cabinet through the airflow outlet.

14 Claims, 2 Drawing Sheets

(51) Int. Cl.
*F24F 11/81* (2018.01)
*F24F 13/20* (2006.01)

(56) References Cited

OTHER PUBLICATIONS

Written Opinion for International Application No. PCT/IB2018/000322; International filing date Mar. 6, 2018; dated Nov. 13, 2018; 5 pages.

* cited by examiner

SLIM FAN COIL UNIT

CROSS REFERENCE TO RELATED APPLICATIONS

This application is a National Stage application of PCT/IB2018/000322, filed Mar. 6, 2018, which is incorporated by reference in its entirety herein.

BACKGROUND

Exemplary embodiments pertain to the art of a fan coil unit of a heating, ventilation and air conditioning system.

A fan coil unit typically includes a fan positioned in a housing or cabinet to direct airflow across a heat exchanger in the cabinet. The airflow then exits the fain coil unit as supply airflow for the heating, ventilation, and air conditioning system, to cool, heat or otherwise condition a conditioned space, depending on the operation mode or configuration of the heating, ventilation, and air conditioning system.

The typical fan configuration and orientation in the cabinet results in inefficient usage of the fan and thus the heat exchanger. Further, the art would well receive a fan coil unit with a reduced thickness compared to a typical fan coil unit, while providing improved fan coil unit performance.

BRIEF DESCRIPTION

In one embodiment, a fan coil unit of a heating, ventilation, and air conditioning system includes a cabinet, a heat exchanger located in the cabinet, an airflow inlet to admit an airflow into the cabinet, and an airflow outlet to allow the airflow to exit the cabinet. A fan is located in the cabinet to urge the airflow through the cabinet. The fan has an axis of rotation perpendicular to a general flow direction of the airflow from the airflow inlet to the airflow outlet.

Additionally or alternatively, in this or other embodiments the fan is located in the cabinet upstream of the heat exchanger.

Additionally or alternatively, in this or other embodiments a separator is located in the cabinet. The separator extends across the fan and divides the cabinet into a cabinet inlet portion and a cabinet outlet portion.

Additionally or alternatively, in this or other embodiments the cabinet inlet portion includes a fan inlet of the fan.

Additionally or alternatively, in this or other embodiments the cabinet outlet portion includes a fan outlet of the fan.

Additionally or alternatively, in this or other embodiments a cross-sectional area of the cabinet inlet portion decreases in size with decreasing distance from the airflow inlet to the fan.

Additionally or alternatively, in this or other embodiments a cross-sectional area of the cabinet outlet portion increases in size with increasing distance from the fan to the airflow outlet.

Additionally or alternatively, in this or other embodiments the separator extends from a first cabinet sidewall to a second cabinet sidewall, opposite the first cabinet sidewall.

Additionally or alternatively, in this or other embodiments a thickness of the fan coil unit is less than 210 millimeters.

Additionally or alternatively, in this or other embodiments the thickness of the fan coil unit is between 150 millimeters and 210 millimeters.

Additionally or alternatively, in this or other embodiments the airflow inlet is positioned at a first endwall of the cabinet and the airflow outlet is positioned at a second endwall of the cabinet opposite the first endwall.

In another embodiment, a method of operating a fan coil unit, includes flowing an airflow into a cabinet via an airflow inlet and flowing the airflow through a fan. The fan is oriented such that a fan axis of rotation is perpendicular to a general flow direction of the airflow from the airflow inlet to an airflow outlet. The airflow is urged across a heat exchanger located in the cabinet, the heat exchanger conditioning the airflow. The conditioned airflow is output from the cabinet through the airflow outlet.

Additionally or alternatively, in this or other embodiments the airflow is flowed through the fan before being urged across the heat exchanger.

Additionally or alternatively, in this or other embodiments the airflow is flowed from the airflow inlet to the fan through a cabinet inlet portion defined at least in part by a first separator leg extending from a first cabinet sidewall to the fan.

Additionally or alternatively, in this or other embodiments a cross-sectional area of the cabinet inlet portion decreases with decreasing distance from the airflow inlet to the fan.

Additionally or alternatively, in this or other embodiments the airflow is flowed from the fan to the airflow outlet through a cabinet outlet portion defined at least in part by a second separator leg extending from the fan to a second cabinet sidewall.

Additionally or alternatively, in this or other embodiments a cross-sectional area of the cabinet outlet portion increases with increasing distance from the fan to the airflow outlet.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
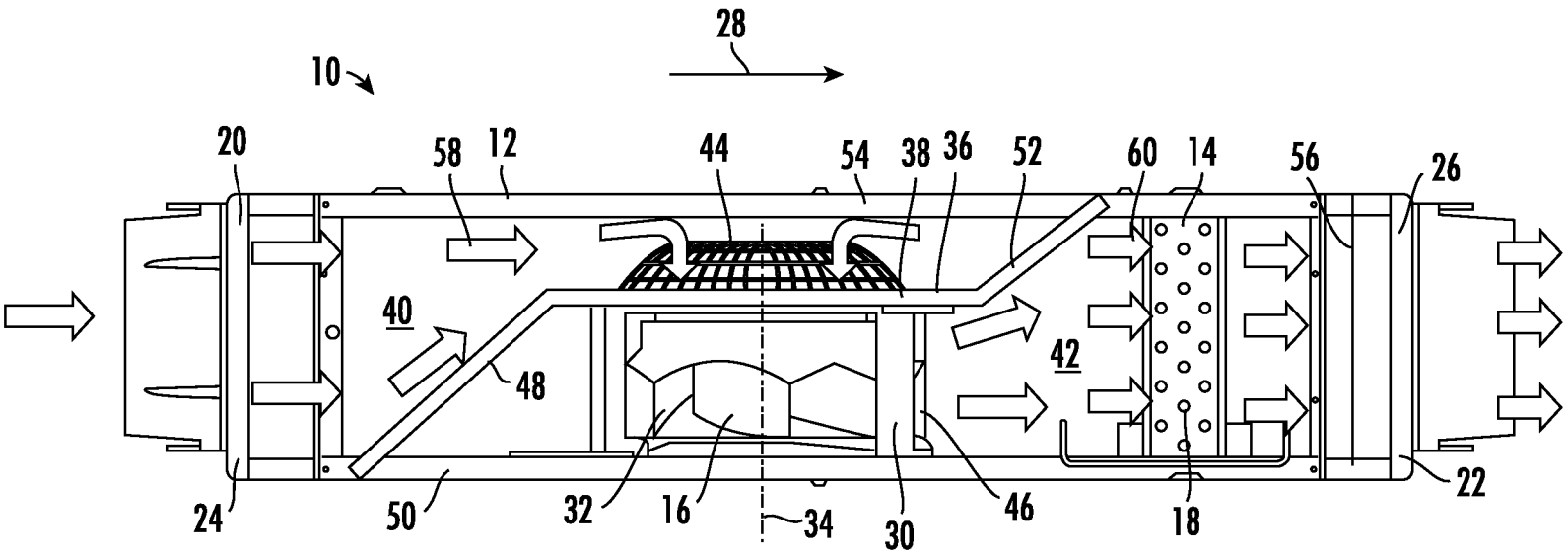
FIG. 1 is a cross-sectional view of an embodiment of a fan coil unit of a heating, ventilation and air conditioning system.

Referring now to FIG. 1, illustrated is a cross-sectional view of a fan coil unit 10 of a heating, ventilation, and air conditioning (HVAC) system. The fan coil unit 10 includes a cabinet or housing duct 12 within which various components are located. For example, housed within the cabinet 12 of the fan coil unit 10 is a heat exchanger assembly 14 configured to heat or cool the adjacent air and a fan assembly 16 configured to circulate air through the heat exchanger assembly 14. Depending on the desired unit characteristics, the fan assembly 16 may be positioned either upstream with respect to the heat exchanger assembly 14 (i.e. a "blow through" configuration), as shown in FIG. 1, or downstream with respect to the heat exchanger assembly 14 (i.e. a "draw through" configuration).

The heat exchanger assembly 14 may include any of a plurality of configurations. As illustrated in FIG. 1, the heat exchanger assembly 14 is a single heat exchanger coil 18 arranged perpendicular to a primary flow direction of air through the cabinet 12. Alternative configurations of the heat exchanger assembly 14 may include multiple heat exchanger coils 18 arranged in a generally V-shaped configuration, a generally A-shaped configuration, or a generally N-shaped configuration, as is known in the art. In embodiments where the fan coil unit 10 is configured to provide cool air, the heat exchanger assembly 14 absorbs heat from the air passing through the heat exchanger assembly 14 and the resultant cool air is provided to a space to be conditioned.

The cabinet 12 includes at least one inlet opening 20 through which air to be conditioned travels to the interior of the cabinet 12. The air being heated or cooled in the fan coil unit 10 may be provided from a return air duct (not shown) connected to a space to be conditioned, or alternatively, may be fresh air drawn in from an outside source or a mixture of return air and fresh air. The cabinet 12 similarly includes at least one outlet opening 22. The outlet opening 22 may, but need not be, connected to ductwork (not shown) to guide and deliver the supply air from the fan coil unit 10 to one or more locations spaces to be conditioned. In the embodiment of FIG. 1, the inlet opening 20 is located as a first cabinet end 24, and the outlet opening 22 is located at a second cabinet end 26 opposite the first cabinet end 24. The airflow flows in a general flow direction 28 from the inlet opening 20 to the outlet opening 22.

The fan assembly 16 includes a fan housing 30 and an impeller 32 located in the fan housing 30 and driven about an axis of rotation 34. The axis of rotation 34 is perpendicular to the general flow direction 28 through the cabinet 12. For example, in the embodiment of FIG. 1, the general flow direction 28 is horizontal from left to right, while the axis of rotation 34 is oriented vertically.

A separator 36 is located in the cabinet 12 and extends across the fan assembly 16, with the fan assembly 16 located at a separator opening 38 in the separator 36. The separator 36 divides the cabinet interior into an inlet portion 40 upstream of the fan assembly 16, and an outlet portion 42 downstream of the fan assembly 16. A fan inlet 44 of the fan assembly 16 is located in the inlet portion 40, while a fan outlet 46 of the fan assembly 16 is located in the outlet portion 42. The separator 36 may be formed from, for example, a plastic or sheet metal material.

The separator 36 includes an upstream leg 48 extending from a first cabinet sidewall 50 upstream of the fan assembly 16. The upstream leg 48 extends to the fan assembly 16 narrowing a cross-sectional flow area of the inlet portion 40 with decreasing distance from the inlet opening 20 to the fan assembly 16. Similarly, the separator 36 includes a downstream leg 52 extending from the fan assembly 16 to a second cabinet sidewall 54 opposite the first cabinet sidewall 50. A cross-sectional area of the outlet portion 42 increases with increasing distance from the fan assembly 16 toward the outlet opening 22. In some embodiments, a cabinet thickness 56 from the first cabinet sidewall 50 to the second cabinet sidewall 54 is less than 210 millimeters. In another embodiment, the cabinet thickness 56 is between 150 millimeters and 210 millimeters, while in still another embodiment the cabinet thickness 56 is less than 150 millimeters.

Figure 2:
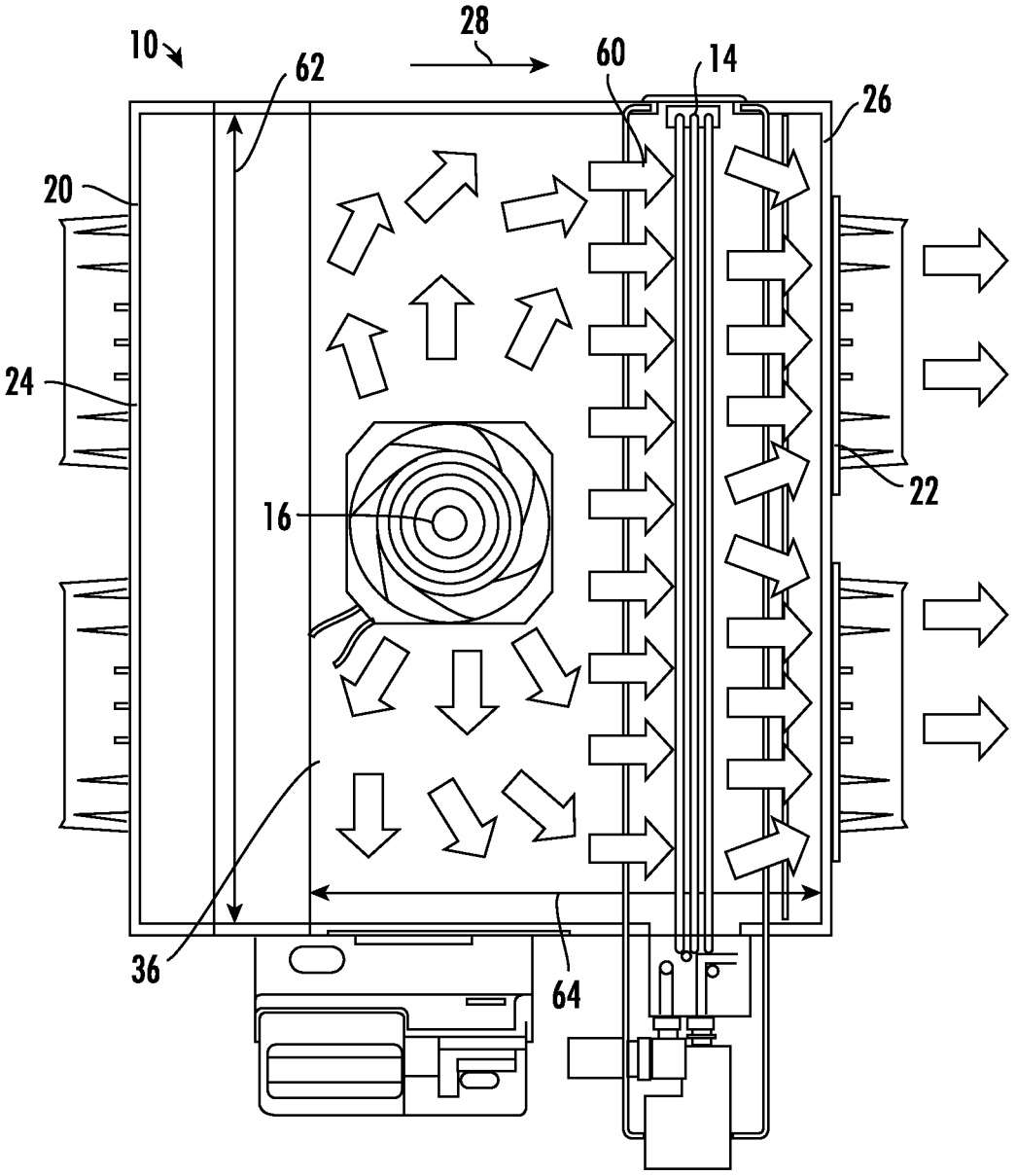
FIG. 2 is another cross-sectional view of an embodiment of a fan coil unit of a heating, ventilation and air conditioning system.

Referring to FIG. 1 and to FIG. 2, in operation, a return airflow 58 flows through the inlet opening 20 and into the inlet portion 40 of the cabinet 12. The return airflow 58 then flows into the fan inlet 44. Referring now to FIG. 2, the airflow is expelled from the fan outlet 46 as supply airflow 60, in all directions across a cabinet width 62 and along an outlet portion length 64. The supply airflow 60 flows along the outlet portion 42 and across the heat exchanger assembly 14. The supply airflow 60 exchanges thermal energy with a fluid flowing through the heat exchanger assembly 14 to either cool or heat the supply airflow 60. The supply airflow 60 then proceeds to the outlet opening 22, exiting the cabinet 12 therethrough.

Orienting the fan assembly 16 in the cabinet 12 transverse to the general flow direction 28 as in the present disclosure allows for reduction in thickness of the fan coil unit 12 compared to a typical fan coil unit. Further, the supply airflow 60 exiting the transversely mounted fan assembly 16 improves heat exchanger assembly 14 utilization across a width of the heat exchanger assembly 14 compared to a typical fan coil unit.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fan coil unit of a heating, ventilation, and air conditioning system, comprising:

a cabinet;

a heat exchanger disposed in the cabinet;

an airflow inlet to admit an airflow into the cabinet;

an airflow outlet to allow the airflow to exit the cabinet;

a fan disposed in the cabinet to urge the airflow through the cabinet, the fan having an axis of rotation perpendicular to a general flow direction of the airflow from the airflow inlet to the airflow outlet; and a separator disposed in the cabinet, the separator extending across the fan and dividing the cabinet into a cabinet inlet portion and a cabinet outlet portion;

wherein a height of the cabinet inlet portion in a direction parallel to the axis of rotation decreases with decreasing distance from the axis of rotation.

2. The fan coil unit of claim 1, wherein the fan is disposed in the cabinet upstream of the heat exchanger.

3. The fan coil unit of claim 1, wherein the cabinet inlet portion includes a fan inlet of the fan.

4. The fan coil unit of claim 1, wherein the cabinet outlet portion includes a fan outlet of the fan.

5. The fan coil unit of claim 1, wherein a height of the cabinet outlet portion in a direction parallel to the axis of rotation increases with increasing distance from the axis of rotation.

6. The fan coil unit of claim 1, wherein the separator extends from a first cabinet sidewall to a second cabinet sidewall, opposite the first cabinet sidewall.

7. The fan coil unit of claim 1, wherein a thickness of the fan coil unit is less than 210 millimeters.

8. The fan coil unit of claim 7, wherein the thickness of the fan coil unit is between 150 millimeters and 210 millimeters.

9. The fan coil unit of claim 1, wherein the airflow inlet is disposed at a first endwall of the cabinet and the airflow outlet is disposed at a second enwall of the cabinet opposite the first endwall.

10. A method of operating a fan coil unit, comprising:

flowing an airflow into a cabinet via an airflow inlet;

flowing the airflow through a fan, the fan oriented such that a fan axis of rotation is perpendicular to a general flow direction of the airflow from the airflow inlet to an airflow outlet;

urging the airflow across a heat exchanger disposed in the cabinet, the heat exchanger conditioning the airflow; and outputting the conditioned airflow from the cabinet through the airflow outlet;

wherein a separator is disposed in the cabinet, the separator extending across the fan and dividing the cabinet into a cabinet inlet portion and a cabinet outlet portion;

wherein a height of the cabinet inlet portion in a direction parallel to the axis of rotation decreases with decreasing distance from the axis of rotation.

11. The method of claim 10, wherein the airflow is flowed through the fan before being urged across the heat exchanger.

12. The method of claim 10, wherein the airflow is flowed from the airflow inlet to the fan through a cabinet inlet portion defined at least in part by a first separator leg extending from a first cabinet sidewall to the fan.

13. The method of claim 10, wherein the airflow is flowed from the fan to the airflow outlet through a cabinet outlet portion defined at least in part by a second separator leg extending from the fan to a second cabinet sidewall.

14. The method of claim 13, wherein a height of the cabinet outlet portion in a direction parallel to the axis of rotation increases with increasing distance from the fan to the airflow outlet.

* * * * *